United States Patent [19]

Masui et al.

[11] 4,144,855

[45] Mar. 20, 1979

[54] DEVICE FOR CONTROLLING THE AIR-FUEL RATIO OF A MIXTURE

[75] Inventors: Takatoshi Masui; Masaki Mituyasu, both of Susono, Japan

[73] Assignee: Toyota Jidosha Kogyo Kabushiki Kaisha, Toyota, Japan

[21] Appl. No.: 723,752

[22] Filed: Sep. 15, 1976

[30] Foreign Application Priority Data

Jun. 9, 1976 [JP] Japan ..... 51-66497

[51] Int. Cl.[2] ..... F02M 7/02

[52] U.S. Cl. ..... 123/119 EC; 123/119 D; 123/124 B; 261/121 B; 261/DIG. 74

[58] Field of Search ..... 123/32 EE, 119 EC, 119 D, 123/124 R, 124 B; 261/121 B, DIG. 74, DIG. 67; 60/276, 285

[56] References Cited

U.S. PATENT DOCUMENTS

| | | | |
|---|---|---|---|
| 1,799,487 | 4/1931 | Stokes | 123/124 R |
| 1,849,530 | 3/1932 | Lemoine | 123/124 R |
| 3,493,217 | 2/1970 | Farley | 261/121 B |
| 3,866,588 | 2/1975 | Nakada et al. | 123/119 D |
| 3,906,910 | 9/1975 | Szlaga, Jr. | 123/119 EC |
| 3,911,884 | 10/1975 | Moriya et al. | 123/32 EE |
| 3,925,521 | 12/1975 | Otani | 261/121 B |
| 3,958,544 | 5/1976 | Shinoda et al. | 123/119 DB |
| 3,963,009 | 6/1976 | Mennesson | 123/119 EC |
| 3,977,375 | 8/1976 | Laprade et al. | 60/276 |
| 4,007,721 | 2/1977 | Reguerio | 261/121 B |
| 4,010,722 | 3/1977 | Laprade et al. | 123/119 EC |
| 4,023,357 | 5/1977 | Masaki | 123/119 EC |
| 4,091,783 | 5/1978 | Laprade et al. | 123/119 D |

FOREIGN PATENT DOCUMENTS

| | | | |
|---|---|---|---|
| 1309866 | 10/1962 | France | 261/DIG. 67 |

*Primary Examiner*—Charles J. Myhre
*Assistant Examiner*—Andrew M. Dolinar
*Attorney, Agent, or Firm*—Stevens, Davis, Miller & Mosher

[57] ABSTRACT

A device for controlling the air-fuel ratio of the mixture supplied to an internal combustion engine having a Venturi-type carburetor is disclosed. The device comprises a sensor for detecting the concentration of oxygen contained in the exhaust gas, an electromagnetic valve arranged in an air bleed passage of said carburetor, which passage is controlled so as to be either of opened or closed by said valve in accordance with a signal from said sensor, and another valve comprising an air valve arranged in said air bleed passage and controlling the quantity of air bleed by changing the opening area of said air bleed passage in accordance with the quantity of the suction air introduced to a combustion chamber.

2 Claims, 1 Drawing Figure

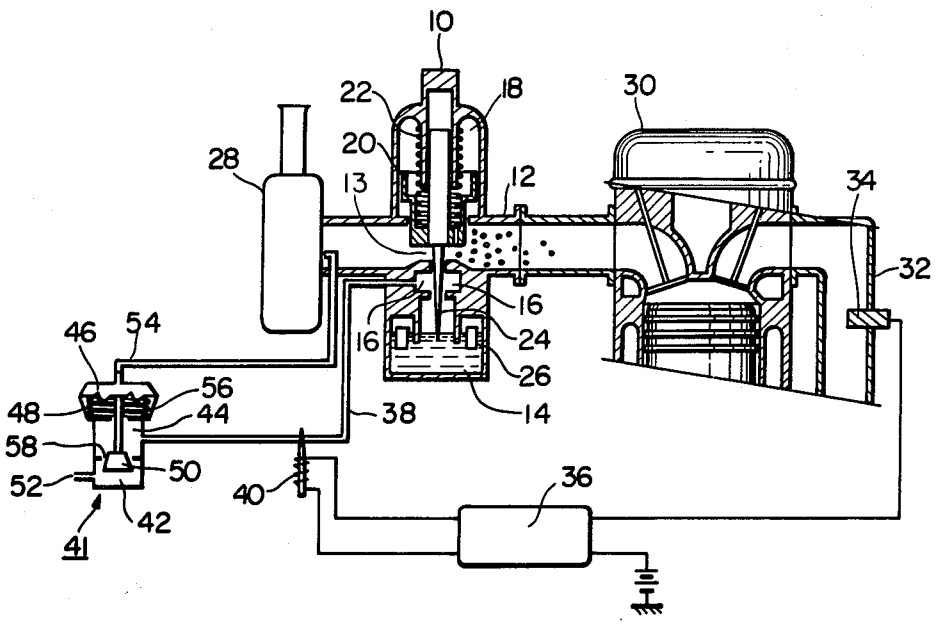
10
12
13
14
16
16
18
20
22
24
26
28
30
32
34
36
38
40
41
42
44
46
48
50
52
54
56
58

DEVICE FOR CONTROLLING THE AIR-FUEL RATIO OF A MIXTURE

This invention relates generally to a device for controlling the air-fuel ratio of a mixture and, more particularly, to such a device for an internal combustion engine having a carburetor-type fuel supply installation.

In order to obtain a suitable air-fuel ratio of the mixture supplied to a combustion chamber, it is required that the suction air and the fuel being supplied to the engine are pertinently and accurately controlled. The conventional carburetor-type internal combustion engine has in an intake passage thereof a Venturi, by which a negative pressure is generated and the liquid fuel is sucked into the intake passage. The quantity of the fuel being sucked is controlled by the Venturi negative pressure. This Venturi-type fuel supply installation involves, however, a disadvantage that the air-fuel ratio of the mixture is influenced by conditions such as temperature and pressure, which has a bad effect on engine performance.

To overcome the above-mentioned disadvantage, an air-fuel ratio controlling device has already been proposed. This controlling device comprises a sensor for detecting the concentration of oxygen contained in the exhaust gas and an electromagnetic valve arranged in an air-fuel mixture passage or an air bleed passage, which valve is actuated in accordance with a signal from said sensor. The quantity of the fuel being sucked is controlled by the electromagnetic valve in addition to the Venturi negative pressure. This known device, however, also involves a disadvantage such that, when a large quantity of suction air is introduced into the engine or the quantity of suction air sharply changes, it is difficult to obtain a suitable quantity of the air bleed required for appropriately controlling the air-fuel ratio of the mixture and the air-fuel ratio shows a large variation.

Accordingly, it is a principal object of the present invention to provide a new and improved device for controlling the air-fuel ratio of the mixture supplied to an internal combustion engine having a carburetor-type fuel supply installation, which device is able to properly control the air-fuel ratio of the mixture in accordance with the quantity of suction air being introduced into a combustion chamber.

This object of the present invention will be readily evident from the following description with reference to the accompanying drawing which is a schematic view of a device for controlling the air-fuel ratio of an internal combustion engine having a variable Venturi-type carburetor.

Referring to the drawing, a variable Venturi-type carburetor of an internal combustion engine, namely a so called SU-type carburetor, is generally indicated by reference numeral 10. This carburetor 10 is located in an intake passage 12 and comprises a float chamber 14, an air bleed chamber 16 communicated with the atmosphere, a negative pressure chamber 18 communicated with the intake passage 12 and a piston 20. When a throttle valve (not shown in the drawing) is opened, the negative pressure in a Venturi portion 13 increases and, thus, the negative pressure in the chamber 18 also increases. When this occurs, as the pressure in the chamber 16 is always maintained at atmospheric pressure, the piston 20 moves upwardly against the force of a spring 22 and the opening area of a fuel supply opening is increased by a needle or bar 24 secured to the bottom end of the piston 20. The level of fuel within the float chamber 14 is maintained at a constant height at the all times by a float member 26. The carburetor 10 of this variable Venturi-type is effective for automatically maintaining the velocity of the air-fuel mixture flowing through the Venturi portion 13 at a constant value, due to the automatic variation of the cross-sectional area of the Venturi in accordance with the quantity of the suction air.

The suction air clarified by an air cleaner 28 is mixed with the fuel by this variable Venturi-type carburetor 10 and the air-fuel mixture is introduced into a combustion chamber of the engine.

A device for detecting the concentration of oxygen contained in the exhaust gas, namely an oxygen sensor 34, is arranged in an exhaust passage 32 of the engine. A signal from the sensor 34 is input to a computer system 36, which controls an electromagnetic valve 40 arranged in an air bleed passage 38. The air bleed passage is connected at one end to the air bleed chamber 16 of the variable Venturi-type carburetor 10 and at the other end to a valve 41, such as a diaphragm valve as shown in the drawing. The valve 41 comprises an air chamber 42 communicated with the atmosphere, a counter chamber 44 and a dynamic pressure chamber 46. The dynamic pressure chamber 46 is separated from the counter chamber 44 by a partition, such as a diaphragm 48. Between the air chamber 42 and the counter chamber 44 is formed a valve opening 58, the opening area thereof being determined by a valve member 50 connected to the diaphragm 48 by a rod member. The air chamber 42 is communicated with the atmosphere by an opening 52 and, thus, the air pressure in the chamber 42 is always maintained at atmospheric pressure. The air bleed passage 38 is connected at the one end thereof to the counter chamber 44. An air passage 54 is connected at one end to the dynamic pressure chamber 46 and at the other end to the intake passage 12 in the vicinity of the air cleaner 28.

This air-fuel ratio controlling device operates as follows. The dynamic air pressure, which is substantially proportional to the quantity of suction air introduced into the engine, is applied into the dynamic pressure chamber 46 of the diaphragm valve 41. When the dynamic pressure increases, the diaphragm 48 moves downwardly against to the force of a compression spring 56 (if the dynamic pressure is insufficient to actuate the diaphragm 48 against to the spring 56, an appropriate amplifier, not shown in the drawing, may be used). Thus, the valve member 50 also moves downwardly and enlarges the opening area of the valve opening 58 positioned between the counter chamber 44 and the air chamber 42. Contrary to this, when the quantity of suction air introduced into the engine decreases and, thus, the dynamic pressure applied to the dynamic pressure chamber 46 decreases, the valve member 50 moves upwardly under the action of the compression spring 56 and, therefore, the opening area of the valve opening 58 becomes narrower.

As described above, with the air-fuel ratio controlling device of the present invention, a required quantity of air bleed is advantageously obtained by changing the opening area of the air bleed passage 38 and, thus, the air-fuel ratio of the mixture supplied to the internal combustion engine is properly compensated.

What we claim is:

1. A device for controlling the air-fuel ratio of the mixture supplied to an internal combustion engine having a Venturi-type carburetor, comprising:

a sensor provided in an exhaust passage of the engine and detecting the concentration of oxygen contained in the exhaust gas;

an electromagnetic valve arranged in an air bleed passage of said carburetor, which passage is controlled so as to be either opened or closed by said valve in accordance with a signal from said sensor, and;

another valve comprising an air valve arranged in said air bleed passage, which air valve continuously controls the quantity of the air passing through said air bleed passage in accordance with the quantity of suction air being introduced into a combustion chamber, said air valve being a diaphragm valve comprising a diaphragm which is actuated by the dynamic pressure of the suction air being introduced into the combustion chamber, a dynamic pressure chamber communicated with an intake passage in the vicinity of an air cleaner, a counter chamber communicated with said air bleed passage and separated from said dynamic pressure chamber by said diaphragm, an air chamber communicated with the atmosphere, a valve opening formed between said counter chamber and said air chamber, and a valve member connected to said diaphragm so as to change the opening area of said valve opening and controlling the quantity of the air passing through said air bleed passage.

2. A device as set forth in claim 1 wherein said electromagnetic valve and said air valve are arranged in series in the air bleed passage of said carburetor.

* * * * *